US010088255B2

(12) United States Patent
Minnich

(10) Patent No.: US 10,088,255 B2
(45) Date of Patent: Oct. 2, 2018

(54) ON-LINE CLEANING OF A HEAT EXCHANGER TUBING USING A BRUSH AND A FLOW DIVERTER

(71) Applicant: BACK PORCH HOLDINGS INC., Calgary, Alberta (CA)

(72) Inventor: Keith R Minnich, Calgary (CA)

(73) Assignee: Back Porch Holdings Inc., Calgary (CA)

( * ) Notice: Subject to any disclaimer, the term of this patent is extended or adjusted under 35 U.S.C. 154(b) by 0 days.

(21) Appl. No.: 15/317,243

(22) PCT Filed: Jun. 9, 2015

(86) PCT No.: PCT/CA2015/050532
§ 371 (c)(1),
(2) Date: Dec. 8, 2016

(87) PCT Pub. No.: WO2015/188272
PCT Pub. Date: Dec. 17, 2015

(65) Prior Publication Data

US 2017/0131048 A1 May 11, 2017

Related U.S. Application Data

(60) Provisional application No. 62/079,487, filed on Nov. 13, 2014, provisional application No. 62/009,816, filed on Jun. 9, 2014.

(51) Int. Cl.
*F28F 17/00* (2006.01)
*F28G 1/12* (2006.01)
(Continued)

(52) U.S. Cl.
CPC ..... *F28G 1/125* (2013.01); *F28D 7/082* (2013.01); *F28F 27/02* (2013.01); *F28G 15/003* (2013.01)

(58) Field of Classification Search
CPC ..... F04B 39/0016; F28G 1/125; F28G 15/03; F28D 7/082; F28F 27/02
(Continued)

(56) References Cited

U.S. PATENT DOCUMENTS 3,883,431 A 5/1975 Ishii et al.
4,044,418 A * 8/1977 Ishii ..... B01D 63/06 137/268
(Continued)

FOREIGN PATENT DOCUMENTS

DE 3824773 A1 1/1990

*Primary Examiner* — Davis Hwu
(74) *Attorney, Agent, or Firm* — Adler Pollock & Sheehan P.C.; Daniel J. Holmander, Esq.

(57) ABSTRACT

Heat transfer equipment often loses heat transfer capacity due to fouling and scaling which results in lost economic value in the form of lost heat, production, and the labor required for cleaning the equipment. A heat exchanger is provided, including: a first means of fluid communication to a shell (5); a second means of fluid communication to the shell; a flow diverter (2) for reversing the flow of fluid from the shell and the first and second means of communication; a tube (6) within the shell in fluid communication with both the first and second means of fluid communication; and a brush positionable within first and second brush housings (3), the brush housings positioned respectively on the first and second means of fluid communication, the brush moveable with the flow of fluid through the tube; wherein the tube is expandable independent of the shell. The tube is fixed to only one end of the shell without using tubesheets.

8 Claims, 4 Drawing Sheets

(51) Int. Cl.
*F28D 7/08* (2006.01)
*F28F 27/02* (2006.01)
*F28G 15/00* (2006.01)

(58) Field of Classification Search
USPC ..... 169/95
See application file for complete search history.

(56) References Cited

U.S. PATENT DOCUMENTS

| | | | | |
|---|---|---|---|---|
| 4,627,486 | A | 12/1986 | Baron | |
| 4,667,732 | A * | 5/1987 | Harding | F28G 1/125 15/3.51 |
| 8,955,581 | B2 | 2/2015 | Minnich | |
| 2011/0247486 | A1 * | 10/2011 | Ohata | F04B 39/0016 92/120 |

* cited by examiner

ON-LINE CLEANING OF A HEAT EXCHANGER TUBING USING A BRUSH AND A FLOW DIVERTER

RELATED APPLICATIONS

This application claims the benefit of U.S. Provisional Patent Application No. 62/009,816, filed Jun. 9, 2014; and U.S. Provisional Patent Application No. 62/079,487, filed Nov. 13, 2014, both of which are hereby incorporated by reference in their entirety.

FIELD OF THE INVENTION

This invention relates to heat exchangers, and more particularly to heat exchangers used in processing produced waters.

BACKGROUND OF THE INVENTION

Heat transfer from a hot fluid to a cold fluid is an important process in virtually all chemical processing, power generation, and oil & gas facilities. The energy efficiency of these plants depends on effective heat transfer. Improvements in waste heat recovery, recovery of waste products, and recycling of waste streams often involve a heat transfer application in which there is a tendency to scale or foul the heat transfer surface. These applications often require heat transfer with small differences in the temperature between the hot and cold fluids and operation at high temperatures and pressures. Heat transfer equipment which loses heat transfer capacity due to fouling and scaling results in lost economic value in the form of lost heat, production, and the labor required for cleaning the equipment. Such demanding heat transfer applications would benefit from heat transfer equipment which is resistant to fouling and scaling.

Zero Liquid Discharge (ZLD) wastewater treatment systems often use evaporation to recover pure water from waste brines. Waste brines often have salts with inverse solubility. As the brine is heated in the evaporator salts precipitate on the heat transfer surface. Calcium sulfate seeded slurry evaporation can be used in applications in which there is a sufficient amount of calcium and sulfate present. In other applications in which the chemistry is not suitable for seeded slurry operation the evaporators must be cleaned frequently.

Enhanced oil recovery processes, including Steam Assisted Gravity Drainage (SAGD) for oil sands, generate produced waters, or waste streams generated by the reuse of produced water, both which have the characteristics of a high pH, and the inclusion of dissolved silica, suspended particulates, oil and grease, and dissolved organics. These streams are referred to as high silica process affected water (HSPAW).

HSPAW is thus a byproduct of the SAGD process used to recover heavy oil. In a SAGD process, steam is injected into an oil bearing formation to heat and thereby reduce the viscosity of the oil. After the steam condenses, it mixes with the oil, and both the oil and water flow to a collection well and then to a separator wherein the oils are separated from the water. After the water leaves the separator it flows to a polishing deoiler where further oil and solids are removed resulting in production water.

The deoiled HSPAW must be treated to remove scale forming constituents, such as silica and hardness, before the water can be reused, for example in the generation of steam. The traditional method for generation of steam in enhanced oil recovery is to utilize a once through steam generator (OTSG) in which steam is generated from a treated feedwater through tubes heated by gas or oil burners. The OTSG feedwater may have a total dissolved solids concentration as high as 8,000 ppm, and requires a hardness level that is less than or equal to 0.5 ppm (as $CaCO_3$) and a silica concentration that is less than or equal to 50 ppm (as $SiO_2$). This method produces a low quality or wet steam, which is approximately 80% vapor and 20% liquid, at pressures ranging from 250 pounds per square inch gauge (psig) up to 2400 psig. This 80% quality steam is either directly injected into the formation; or in some cases the 80% vapor is separated from the 20% water and then the vapor is injected into the formation. Either a portion or all of the 20% blowdown, which has a concentration of dissolved organics of approximately 8,000 ppm and a concentration of silica of approximately 250 ppm (as $SiO_2$) is disposed as a wastewater, usually through deep well injection.

Heat exchangers are part of the above described steam generation process, however, fouling and scaling of the heat transfer surface in heat exchangers reduces heat transfer efficiency and capacity. Various heat exchanger designs and operating practices have been developed to deal with this fouling and scaling. All of these methods have one or more of the following limitations: pressure and temperature limitations; mechanical cleaning not being practical; fouling/scaling material removal requiring off-line chemical or mechanical cleaning; on-line fouling/scaling devices not being monitored during normal operation; and a high cost.

There are two broad categories of heat exchanger: plate and tubular. Plate heat exchangers are configured as either plate and frame, or spiral. Both these types of plate heat exchanger are limited to pressures in the range of 10 to 20 barg. The plate type designs are not suitable for on-line mechanical cleaning. Tubular heat exchangers, containing a plurality of tubes, are capable of operation at 100 barg or higher. Most of these designs are variations on the shell and tube type. The shell and tube types with tubesheets are suitable for both on-line and off-line mechanical cleaning. In both on-line and off-line cleaning for heat exchangers with more than several hundred square meters of heat transfer surface, there are tens to hundreds of tubes. The length to diameter ratio of heat transfer tubes in typical tubular heat exchangers is in the range of 100 to 700.

For on-line brush cleaning of shell and tube heat exchangers, each tube must have a brush and a housing at both ends of the tube devices for receiving the brush. None of the on-line configurations available provide a practical method for monitoring the status of the on-line cleaning device. For off-line mechanical cleaning, the cleaning process must be repeated for each and every tube. Off-line cleaning of shell and tube heat exchangers with hundreds of tubes often takes 5 to 10 days.

There is a lack of heat exchangers wherein on-line cleaning devices can be monitored, which can operate at pressures between 50 and 100 barg, and which can be economically cleaned offline.

SUMMARY OF THE INVENTION

A heat exchanger is provided, including: a first means of fluid communication to a shell; a second means of fluid communication to the shell; a tube within the shell in fluid communication with both the first and second means of fluid communication; a means of flow diversion for reversing the flow of fluid in the tube; and a brush positionable within first and second brush housings, the brush housings positioned respectively on each end of the tube, the brush moveable with the flow of fluid through the tube; wherein the tube is fixed to only one end of the shell without using tubesheets; and wherein the tube is expandable independent of the shell.

Another heat exchanger is provided including a first means of fluid communication to a shell; a second means of fluid communication to the shell; a tube within the shell in fluid communication with both the first and second means of fluid communication; the tube having a plurality of elongated portions running a length of the shell; first and second plates positioned within the shell transverse to the length of the shell, the first and second plates having apertures through which pipe conduits pass through, the conduits arranged so that there is annular flow between the outside of the tube and the inside of the pipe conduits, the first and second plates supporting the pipe conduits within the shell; wherein the tube is fixed to only one end of the shell without using tubesheets; and wherein the tube is expandable independent of the shell.

A heat exchanger is provided, including a first fluid connection to a shell; a second fluid connection to the shell; a flow diverter for reversing the flow of fluid from the shell and the first and second fluid connections; a tube within the shell in fluid communication with both the first and second fluid connections; and a brush positionable within first and second brush housings configured to house the brush, the brush housings positioned respectively on the first and second fluid connections, the brush moveable with flow of fluid through the tube; wherein the tube is expandable independent of the shell.

The time taken by the brush to move from one of the brush housings to the other brush housing is determined to assess the cleanliness of the tube. The first and second brush housings may each include a proximity switch.

The tube includes a plurality of straight segments and a plurality of curved segments, wherein the number of curved segments is an odd number. The straight segments extend along a length of the shell.

The flow diverter may be a switching valve. The tube may enter the shell through a tube inlet, the tube fixed to the tube inlet. The tube may exit the shell though a tube outlet, the tube fixed to the tube outlet. The tube and shell may expand and contract independently. The heat exchanger may include cleaning connections for insertion of cleaning chemicals in the tube.

A heat exchanger is provided, including a first fluid connection to a shell; a second fluid connection to the shell; first and second plates positioned within the shell transverse to the length of the shell, the first and second plates having apertures through which pipe conduits pass, the first and second plates supporting the pipe conduits within the shell; a tube within the shell in fluid communication with both the first and second means of fluid communication; the tubes having a plurality of elongated portions running a length of the shell within the conduits; the tube positioned within the conduits to allow annular flow between the tube and the pipe conduits; and wherein the tube is expandable independent of the shell. The heat exchanger length to diameter ration of the tube may be between 2400 and 5000.

A heat exchanger is provided, including a first fluid communication means to a shell; a second fluid communications means to the shell; flow diversion means for reversing the flow of fluid from the shell and the first and second fluid connections; a tube within the shell in fluid communication with both the first and second fluid communication means; and a brush positionable within first and second brush housings configured to house a brush, the brush housings positioned respectively on the first and second fluid communications means, the brush moveable with flow of fluid through the tube; wherein the tube is expandable independent of the shell.

DETAILED DESCRIPTION OF THE INVENTION

Figure 1:
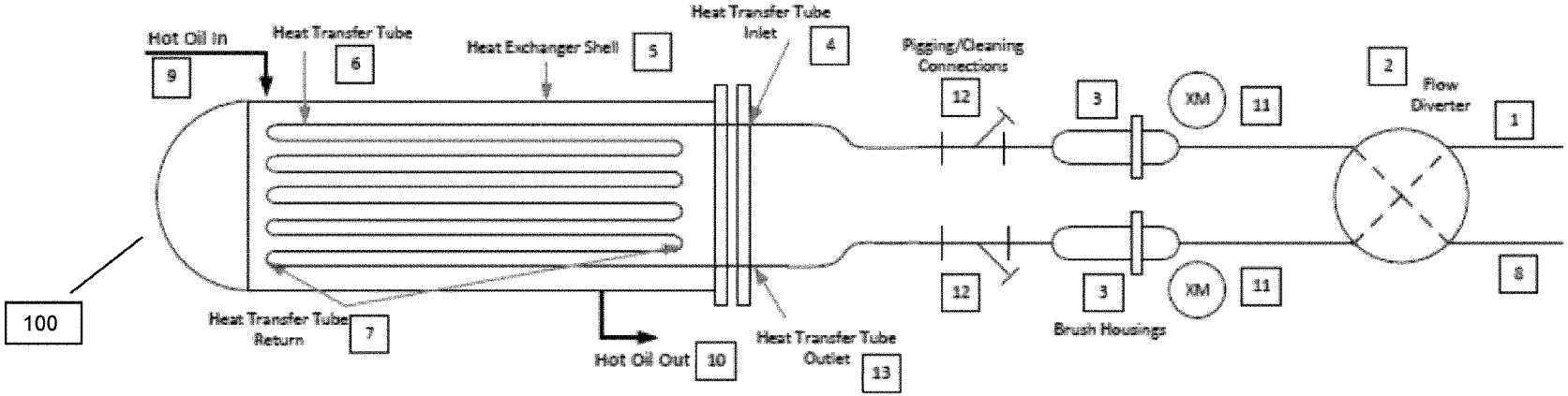
FIG. 1 is a cross sectional view of an embodiment of a heat exchanger without tubesheets according to the invention.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

The term "invention" and the like mean "the one or more inventions disclosed in this application", unless expressly specified otherwise.

The terms "an aspect", "an embodiment", "embodiment", "embodiments", "the embodiment", "the embodiments", "one or more embodiments", "some embodiments", "certain embodiments", "one embodiment", "another embodiment" and the like mean "one or more (but not all) embodiments of the disclosed invention(s)", unless expressly specified otherwise.

A reference to "another embodiment" or "another aspect" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise. The term "plurality" means "two or more", unless expressly specified otherwise. The term "herein" means "in the present application, including anything which may be incorporated by reference", unless expressly specified otherwise.

The term "e.g." and like terms mean "for example", and thus does not limit the term or phrase it explains.

The term "respective" and like terms mean "taken individually". Thus if two or more things have "respective" characteristics, then each such thing has its own characteristic, and these characteristics can be different from each other but need not be. For example, the phrase "each of two machines has a respective function" means that the first such machine has a function and the second such machine has a function as well. The function of the first machine may or may not be the same as the function of the second machine.

Where two or more terms or phrases are synonymous (e.g., because of an explicit statement that the terms or phrases are synonymous), instances of one such term/phrase does not mean instances of another such term/phrase must have a different meaning. For example, where a statement renders the meaning of "including" to be synonymous with "including but not limited to", the mere usage of the phrase "including but not limited to" does not mean that the term "including" means something other than "including but not limited to".

Neither the Title (set forth at the beginning of the first page of the present application) nor the Abstract (set forth at the end of the present application) is to be taken as limiting in any way as the scope of the disclosed invention(s). An Abstract has been included in this application merely because an Abstract of not more than 150 words is required under 37 C.F.R. Section 1.72(b) or similar law in other jurisdictions. The title of the present application and headings of sections provided in the present application are for convenience only, and are not to be taken as limiting the disclosure in any way.

Numerous embodiments are described in the present application, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural and logical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

No embodiment of method steps or product elements described in the present application constitutes the invention claimed herein, or is essential to the invention claimed herein, or is coextensive with the invention claimed herein, except where it is either expressly stated to be so in this specification or expressly recited in a claim.

Figure 2:
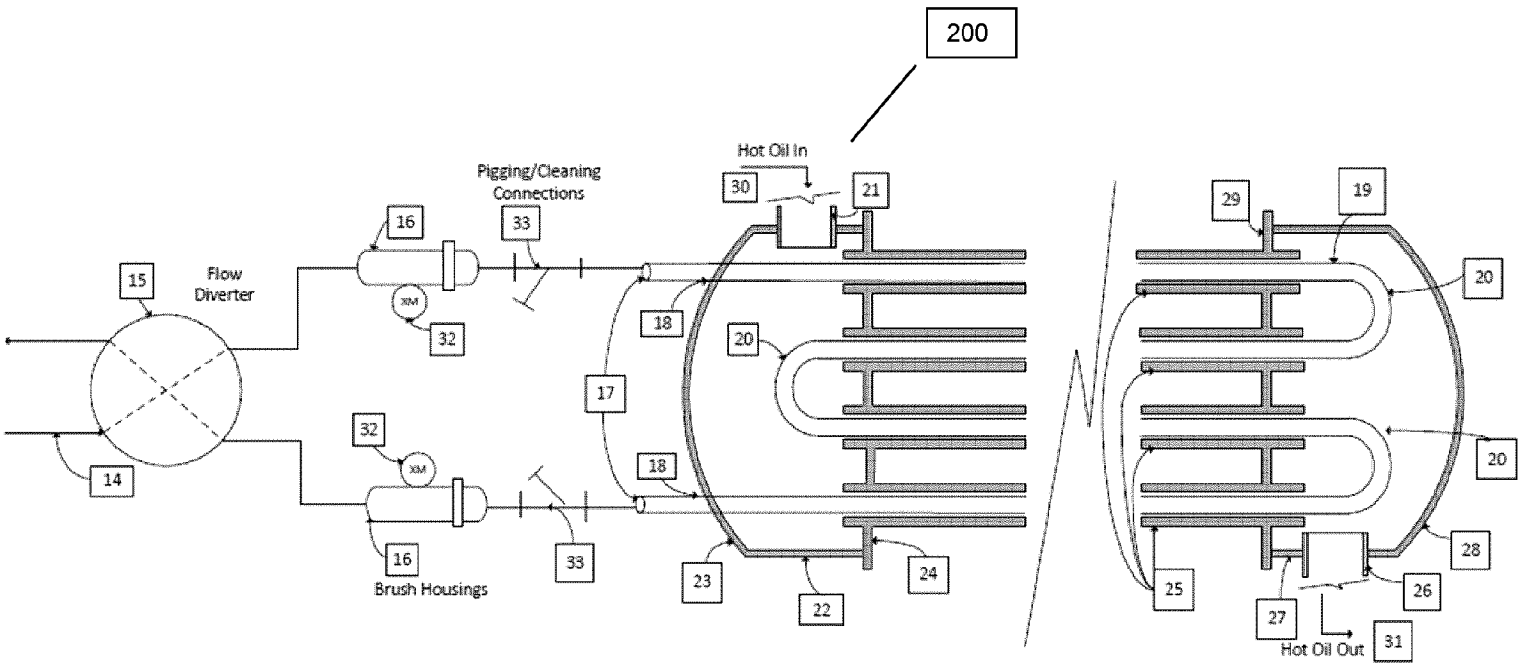
FIG. 2 is a cross sectional view of an alternative embodiment of a heat exchanger without tubesheets according to the invention.

Embodiments of heat exchangers according to the invention are shown in FIGS. 1 and 2. In these embodiments, the exchanger transfers heat across a surface, for example, in an embodiment of the invention, the wall of a heat transfer tube. The fluid in the tube is referred to as the tube side fluid, and the fluid outside of the tube is referred to as shell side fluid. In an embodiment of the invention, the shell side fluid is hot oil. In another embodiment of the invention the shell side fluid is steam.

With reference to FIG. 1, fluid, such as water, flows into the heat exchanger (100) through tube side fluid inlet (1) and then into flow diverter (2). Flow diverter (2) is configured to be able to reverse the direction of fluid flow through heat exchanger (100). After passing through flow diverter (2), and then brush housing (3), the fluid enters the shell (5) of the heat exchanger (100) through tube inlet (4) into heat transfer tube (6).

Heat transfer tube (6) is pipe, and has a wall thickness between schedule 5 and schedule 120, as required by an operating pressure of 50 to 100 barg. Heat transfer tube (6) is contained within heat exchanger shell (5). Tube inlet (4) may be a penetration in a shell head, such as a pipe cap, wherein the pipe cap has the same diameter as the shell (5), which is welded to shell (5); or may be a nozzle in a blind flange bolted to a second flange welded to the shell (5) allowing the removal of the heat transfer tube (6) by unbolting the inlet end of the heat exchanger (100). Heat transfer tube (6) penetrates and passes through tube inlet (4) and is fixed to tube inlet (4), for example by welding on both sides of the pipe cap or blind flange.

Shell (5) of the heat exchanger (100) typically has a length of between 40 feet and 80 feet. Heat transfer tube (6) typically has a diameter between 2 inches and 4 inches. After entering shell (5), the heat transfer tube (6) extends the length of shell (5), bends at 180 degrees (7), then extends the length of shell (5) back to the inlet end, and then bends again at 180 degrees (7). This configuration is repeated until the number of straight lengths of heat transfer tube (6) in shell (5) is between, for example, 6 and 10, although more or less straight lengths may be used. The number of return bends (7) is an odd number so that one end of the last straight length is at the inlet end of the heat exchanger (100). The opposite end of heat transfer tube (6) penetrates a pipe cap or blind flange in the same manner as tube inlet (4) to allow the flow to exit the shell (5) at outlet (13), although this flow can be reversed by use of flow diverter (2). This arrangement anchors tube (6) to one end of shell (5) and allows the tube (6) and shell (5) to expand and contract in length independently of each other. The fluid exits the heat exchanger through outlet (8). The heat transfer fluid, such as hot oil or steam, on the shell side of the heat exchanger enters the heat exchanger at inlet (9) and exits at outlet (10).

Figure 3:
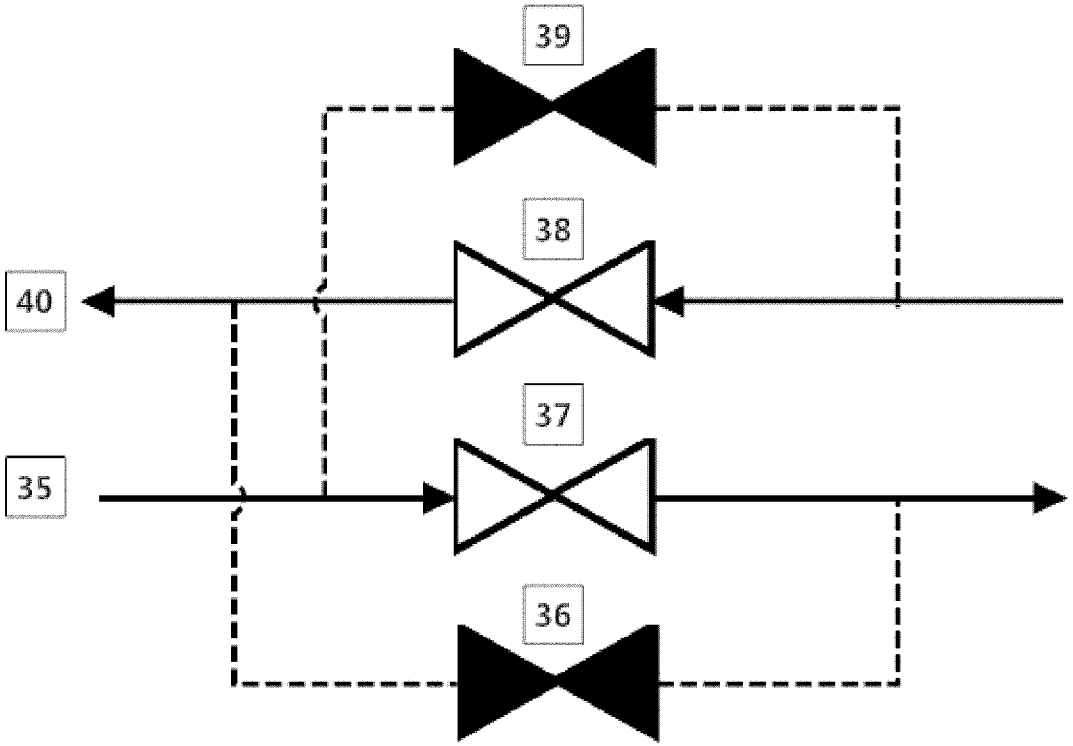
FIG. 3 is a schematic view of an embodiment of a switching valve according to the invention, allowing fluid flow in a first direction.
Figure 4:
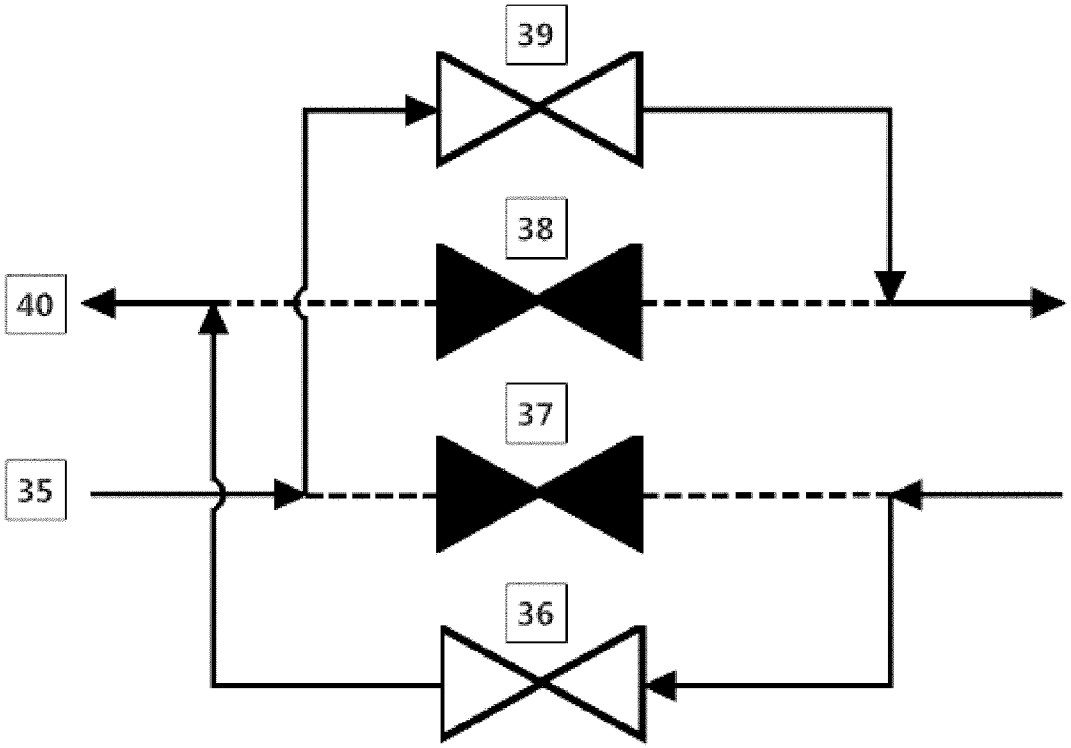
FIG. 4 is a schematic view of the embodiment of a switching valve according to the invention, reversing the fluid flow.

To prevent fouling/scaling material from building up in heat transfer tube (6) mechanical brushing of heat transfer tube (6) can occur every few hours by reversing the direction of the flow through the tube using flow diverter (2). Flow diverter (2) may be a mechanical flow diverter or, alternatively, may be switching valves. An embodiment of switching valves is shown in FIGS. 3 and 4. FIG. 3 shows fluid flow in (35) through valve (37) and return flow through valve (38) and then fluid flow out (40). The flow is reversible by closing valve (37) and valve (38) and opening valve (39) and valve (40). FIG. 4 shows fluid flow in (35) through valve (39) and return flow through valve (36) and then fluid flow out (40).

After the fluid flow is reversed, a wire brush, which normally resides in one of the two brush housings (3), may be hydraulically propelled through heat transfer tube (6). When the brush arrives in the other housing it actuates a proximity switch (11). The brushing action can be repeated as many times as necessary by reversing the flow to remove material from the inside of heat transfer tube (6). The signal from the proximity switch (11) can be used in a programmable logic controller to determine the effectiveness of the brushing by measuring the transit time between the two housings (3). The signal can also be used to initiate sequential brushing actions.

Mechanical brushing may not always be effective at preventing formation of deposits in the tube (6). Deposits which form can be chemically removed by circulating a cleaning chemical through cleaning connections (12). The cleaning connections (12) may be spool pieces and can be removed from the piping to allow the installation of pigging diversion devices and piping for mechanical cleaning. The fact that there is only one heat transfer tube (6) in the exchanger (100) makes mechanical cleaning by pigging practical.

This arrangement of heat transfer surface allows for the use of proximity sensors for the on-line brushing and off-line pigging, neither of which are practical in conventional tubular heat exchangers.

Elimination of tubesheets and the positioning of shell (5) and tube (6) allow shell (5) and tube (6) to expand and contract independently and thereby create a practical and economical design for high pressure and high temperature service.

Another embodiment of a heat exchanger according to the invention is shown in FIG. 2. In this embodiment, the exchanger (200) transfers heat across a surface, for example, in an embodiment of the invention, the wall of a heat transfer tube (19).

Tube side fluid, typically water, flows into the heat exchanger (200) through tube side inlet (14) and then into flow diverter (15). Flow diverter (15) can be single device, or can be an alternative reversal means, such as switching valves. An embodiment of switching valves is shown in FIGS. 3 and 4. FIG. 3 shows fluid flow in (35) through valve (37) and return flow through valve (38) and then fluid flow out (40). The flow is reversible by closing valve (37) and valve (38) and opening valve (39) and valve (40). FIG. 4 shows fluid flow in (35) through valve (39) and return flow through valve (36) and then fluid flow out (40). Flow diverter (15) can change the direction of flow through the heat exchanger (200). After passing through flow diverter (15), then brush housing (16) to heat transfer tube connection (17), the fluid enters the heat exchanger (200) passing through shell head mechanical connection (18).

The heat transfer tube (19) is typically a pipe, with a wall thickness between schedule 5 and schedule 120, as required by the operating pressure. Heat transfer tube (19) passes back and forth in "S" serpentine manner with straight lengths. The transition from one straight length to the next is at 180 degree U-bend (20). The number of straight lengths determines the number of tube side passes in the heat exchanger as described previously in relation to FIG. 1.

The shell includes three sections. The first section of the shell (22) forms a chamber having inlet nozzle (21), head (23), and flat plate (24) which is perforated with apertures each sized to fit conduit (25). The number of apertures in flat plate (24) is equal to the number of tube (19) side passes. The heat transfer tube (19) penetrates the shell by passing through aperture openings in the flat plate (24). Tube to shell head mechanical connections (18) can be made by welding the heat transfer tube (19) to the shell section head (23).

The second section of the shell includes conduits (25). The number of conduits is equal to the number of tube (19) side passes. The conduits (25) penetrate and are connected, for example by welding, to flat plate (24). Conduits (25) are elongated and run adjacent to tube (19) with space between conduit (25) and tube (19) to allow the passage of shell side fluid.

The third section of the shell (27) is a chamber including outlet nozzle (26), head (28), and perforated flat plate (29) with apertures each sized to receive conduits (25) and are connected to conduits (25) as described previously in relation to flat plate (24). The number of apertures in flat plate (29) is equal to the number of tube (19) side passes.

In operation, shell side fluid, such as hot oil, enters the first section of the shell through inlet nozzle (30), then flows through conduits (25) to the third shell chamber, and then exits the heat exchanger through outlet nozzle (31). It is appreciated that with the appropriate baffling inside shell chamber (22) the hot oil outlet (31) can be located in chamber (22).

The diameter of the conduits (25) and the heat transfer tube (19) are selected to optimize velocity and turbulence of the hot oil in the annular space between tube (19) and conduit (25) to balance the heat transfer coefficient and hot oil pressure drop.

The heat exchanger typically has a length of between 40 feet and 80 feet. The heat transfer tube (19) typically has a length between 160 feet and 800 feet, and a diameter between 2 inches and 4 inches.

After entering the first shell section the heat transfer tube (19) extends the length of the second shell section through one of several conduits (25), enters the third shell section through plate (24), makes a 180 degree return U-bend (20), then extends the full length of the second shell section through another conduit (25) back to the first shell section, and then makes another 180 degree return bend (20). The process is typically repeated until the number of straight lengths of heat transfer tube (19) is between 4 and 10, although there may be fewer or more straight lengths. The number of return bends (20) is an odd number so that the end of the last straight length is at the tube side inlet end of the heat exchanger. The end of the heat transfer tube (19) penetrates the shell head (23) at the tube to shell head mechanical connections (18). This arrangement anchors the tube (19) to one end of the shell and allows the tube (19) and shell to expand and contract in length independently from each other.

Similarly as described in the previous embodiment, the deposition of fouling/scaling material onto the heat transfer tube (19) can be prevented by mechanical brushing of the heat transfer tube (19) every few hours by reversing the direction of the flow through the tube using flow diverter (15). After the flow is reversed, a wire brush, which normally resides in one of the brush housings (16), is hydraulically propelled through the heat transfer tube (19). When the brush arrives in the other housing it actuates a proximity switch (32). The brushing action can be repeated as many times as necessary to remove material from the inside of the heat transfer tube (19). The signal from the proximity switch (32) can be used in a programmable logic controller to determine the effectiveness of the brushing based on the measured transit time. The signal can also be used to initiate sequential brushing actions.

As described with respect to the previous embodiment, mechanical brushing might not always be effective at preventing formation of deposits on the tube. Deposits which form can be chemically removed through cleaning connections (33). The cleaning connections (33) may be spool pieces and can be removed from the piping to allow the installation of pigging diversion devices and piping for mechanical cleaning. The fact that there is only one heat transfer tube (19) in heat exchanger (200) makes mechanical cleaning by pigging practical.

The length to diameter ratio of heat transfer tubes in typical tubular heat exchangers is in the range of 100 to 300. The length to diameter ratio of heat transfer tube (19) according to the invention is 2,400 to 5,000. This arrangement of the heat transfer surface allows for the use of proximity sensors for the on-line brushing and off-line pigging, neither of which would be practical otherwise.

Elimination of tubesheets and allowing the shell and tube to expand and contract independently provides a practical and economical design for high pressure and high temperature service. In the embodiment of the invention wherein hot oil is used as the shell side fluid, the conduits (25) allow positive control over the heat transfer and pressure drop of the hot oil.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow As will be apparent to those skilled in the art, the various embodiments described above can be combined to provide further embodiments. Aspects of the present systems, methods and components can be modified, if necessary, to employ systems, methods, components and concepts to provide yet further embodiments of the invention. For example, the various methods described above may omit some acts, include other acts, and/or execute acts in a different order than set out in the illustrated embodiments.

Further, in the methods taught herein, the various acts may be performed in a different order than that illustrated and described. Additionally, the methods can omit some acts, and/or employ additional acts.

These and other changes can be made to the present systems, methods and articles in light of the above description. In general, in the following claims, the terms used should not be construed to limit the invention to the specific embodiments disclosed in the specification and the claims, but should be construed to include all possible embodiments along with the full scope of equivalents to which such claims are entitled. Accordingly, the invention is not limited by the disclosure, but instead its scope is to be determined entirely by the following claims.

The invention claimed is:

1. A heat exchanger comprising:

a first fluid connection to a shell;

a second fluid connection to the shell;

first and second plates positioned within the shell transverse to the length of the shell, the first and second plates having apertures through which pipe conduits pass, the first and second plates supporting the pipe conduits within the shell;

a tube within the shell in fluid communication with both the first and second means of fluid communication; the tubes having a plurality of elongated portions running a length of the shell within the conduits; the tube positioned within the conduits to allow annular flow between the tube and the pipe conduits; and wherein the tube is expandable independent of the shell.

2. The heat exchanger of claim 1 further comprising a flow diverter configured to reverse the flow of fluid through the tube.

3. The heat exchanger of claim 2 further comprising a brush positionable within first and second brush housings each configured to house the brush, the brush housings positioned respectively on the first and second fluid connections, the brush moveable with flow of fluid through the tube.

4. The heat exchanger of claim 3 wherein time taken by the brush to move from one of the brush housings to the other brush housing is determined.

5. The heat exchanger of claim 4 wherein the time is used to determine the cleanliness of the tube.

6. The heat exchanger of claim 2 wherein the flow diverter is a switching valve.

7. The heat exchanger of claim 3 wherein the first and second brush housings each comprise a proximity switch.

8. A heat exchanger, comprising:

a first fluid communication means to a shell;

a second fluid communications means to the shell;

flow diversion means for reversing the flow of fluid from the shell and the first and second fluid connections;

a tube within the shell in fluid communication with both the first and second fluid communication means;

a brush positionable within first and second brush housings configured to house a brush, the brush housings positioned respectively on the first and second fluid communications means, the brush moveable with flow of fluid through the tube; and wherein the tube is expandable independent of the shell.

* * * * *